US010898868B2

(12) United States Patent
Yueh

(10) Patent No.: US 10,898,868 B2
(45) Date of Patent: Jan. 26, 2021

(54) PORTABLE BUBBLE WATER BOTTLE

(71) Applicant: Chao-Yu Yueh, Taipei (TW)

(72) Inventor: Chao-Yu Yueh, Taipei (TW)

( * ) Notice: Subject to any disclaimer, the term of this patent is extended or adjusted under 35 U.S.C. 154(b) by 0 days.

(21) Appl. No.: 16/529,843

(22) Filed: Aug. 2, 2019

(65) Prior Publication Data

US 2019/0351376 A1 Nov. 21, 2019

Related U.S. Application Data

(63) Continuation-in-part of application No. 15/668,923, filed on Aug. 4, 2017, now Pat. No. 10,471,400.

(30) Foreign Application Priority Data

Apr. 14, 2017 (TW) ..... 106205218 U

(51) Int. Cl.

| | |
|---|---|
| ***B01F 3/04*** | (2006.01) |
| ***B01F 15/02*** | (2006.01) |
| ***A45F 3/18*** | (2006.01) |
| ***B65D 85/73*** | (2006.01) |
| ***B65D 81/32*** | (2006.01) |

(52) U.S. Cl.

CPC ..... *B01F 3/04801* (2013.01); *A45F 3/18* (2013.01); *B01F 15/0261* (2013.01); *B65D 81/3222* (2013.01); *B65D 85/73* (2013.01); *B01F 2003/049* (2013.01); *B01F 2215/0022* (2013.01)

(58) Field of Classification Search

CPC .... A45F 3/18; B01F 3/04801; B01F 15/0261; B01F 2003/049; B01F 2215/0022; B65D 81/3222; B65D 85/73

USPC ..... 261/64.1, 75, 119.1, DIG. 7

See application file for complete search history.

(56) References Cited

U.S. PATENT DOCUMENTS

| | | | | |
|---|---|---|---|---|
| 2,345,081 | A | 3/1944 | Ward | |
| 2,805,846 | A | 9/1957 | Dewan | |
| 3,613,954 | A | 10/1971 | Bayne | |
| 4,399,744 | A | 8/1983 | Ogden | |
| 4,457,877 | A | 7/1984 | Love et al. | |
| 4,867,209 | A | 9/1989 | Santoiemmo | |
| 5,460,846 | A | 10/1995 | Stumphauzer et al. | |
| 5,531,254 | A | 7/1996 | Rosenbach | |
| 10,471,400 | B2 * | 11/2019 | Yueh | B65D 81/3222 |
| 2011/0115103 | A1 | 5/2011 | Tatera | |
| 2013/0113124 | A1 | 5/2013 | Hoffmann | |

* cited by examiner

*Primary Examiner* — Charles S Bushey

(74) *Attorney, Agent, or Firm* — McClure, Qualey & Rodack, LLP

(57) ABSTRACT

A portable bubble water bottle of the present application includes a first space, a second space, an one-way gas valve and a gas cylinder. The second space is located in the first space along the first projection direction. The one-way gas valve connects the first space with the second space. The gas cylinder is located in the second space, and has a gas outlet connected to the one-way gas valve.

12 Claims, 9 Drawing Sheets

PORTABLE BUBBLE WATER BOTTLE

This application is a continuation-in-part of application Ser. No. 15/668,923, filed on Aug. 4, 2017, now U.S. Pat. No. 10,471,400.

BACKGROUND OF THE INVENTION

Field of the Invention

This invention relates to a bubble water bottle, in particular, to a portable bubble water bottle.

Descriptions of the Related Art

As the advantages of drinking bubble water are raised, drinking bubble water is increasingly popular among the public, apart from purchasing bubble water, the practitioner also has developed the bubble water machine to allow the public to make bubble water at home.

Refer to FIG. 1, the prior bubble water machine 40 mainly consists of a cabinet 41, a gas cylinder 42, a cup 43 and a gas-guide tube 44. The gas cylinder 42 is filled with carbon dioxide, and installed at one side of the cabinet 41. The cup 43 can be placed at another side of the cabinet 41, and the cup 43 is connected to the gas cylinder 42 by the gas-guide tube 44. The gas-guide tube 44 is dipped into the cup 43 to mix carbon dioxide gas in the gas cylinder 42 with water in the cup 43 and thus to make bubble water. At last, the cup 43 is taken out of the cabinet 41, and then the user can drink the bubble water in the cup 43 directly or pour into other container for drinking.

Due to the bubble water machine will take up a fixed space, some practitioners also launch the portable bubble water bottle. Refer to FIG. 2, the prior bubble water bottle 50 mainly consists of a cover 51, a cup 52, a gas-guide tube 53 and a gas cylinder 54. The cover 51 is connected to the cup 52, besides, the gas-guide tube 53 extends into the cup 52 via the cover 51. The gas cylinder 54 is connected to one end of the gas-guide tube 53 exposed outside the cover 51 to mix carbon dioxide gas in the gas cylinder 54 with water in the cup 52 and thus to make bubble water.

However, the gas cylinder is exposed outside while using portable bubble water bottle. If the user collides against the gas cylinder by accident while using the bubble water bottle, it may lead to the detachment of connection between the gas cylinder and gas-guide tube. The gas cylinder is filled with high pressure gas, so that the gas cylinder may be jetted to some place with high speed when the gas cylinder is detached from the gas-guide tube, thus causing danger. For this reason, it is one of the important subjects to provide a portable gas cylinder that may avoid exposed gas cylinder, so as to take convenience and safety into consideration.

SUMMARY OF THE INVENTION

In view of the foregoing, the present invention is to provide a portable bubble water bottle that can avoid exposed gas cylinder and improve the safety of use.

To reach the above purpose, a portable bubble water bottle is introduced including a first closed sidewall, a first bottom, a second closed sidewall, a second bottom and an one-way gas valve. The first closed sidewall has a first end and a second end, and the first end has a first opening. The first bottom extends to a second end of the first closed sidewall, and has a second opening. The second closed sidewall has a third end and a fourth end, besides, the third end is connected to the periphery of the second opening of the first bottom, and extends towards the first opening. The second bottom extends to the fourth end of the second closed sidewall. The first closed sidewall, the first bottom, the second closed sidewall and the second bottom form the first space, while the second closed sidewall and the second bottom form the second space. The one-way gas valve is set at the second bottom, and connects the first space with the second space.

In one embodiment of the present invention, the portable bubble water bottle further includes a cover, which is connected to the first end of the first closed sidewall to seal the first space.

In one embodiment of the present invention, the portable bubble water bottle further includes a pedestal, which is connected to the third end of the second closed sidewall to seal the second space.

In one embodiment of the present invention, the portable bubble water bottle further includes a gas cylinder, which is connected to a limited component of the pedestal and is located at the second space; besides, a gas outlet of gas cylinder is connected to the one-way gas valve.

In one embodiment of the present invention, the volume of the second space is smaller than that of the first space.

To reach the above purpose, a portable bubble water bottle is introduced including a first space, a second space, an one-way gas valve and a gas cylinder. The second space is located in the first space along the first projection direction. The one-way gas valve connects the first space with the second space. The gas cylinder is located in the second space, and has a gas outlet connected to the one-way gas valve.

In one embodiment of the present invention, the second projection direction of the second space is located in the first space, besides, the first projection direction has 90 degrees from the second projection direction.

In one embodiment of the present invention, the first projection direction of the gas cylinder is located in the first space, besides, the second projection direction is located in the first space.

To reach the above purpose, a portable bubbly water bottle includes an outer shell, a separated cell body, a bottom cap and a gas feeder. The outer shell from up to down defines a drinking part, a cylinder wall and an assembling part. The separated cell body is disposed below the outer shell, and from outside to inside defines a gas valve cell and a gas cylinder cell. The gas valve cell has a connecting hole, and the gas cylinder cell sinks toward the drinking part. The top side of separated cell body and the inside of outer shell together define the fluid storage space. The bottom cap covers the separated cell body and assembling part of outer shell from below, and the top side of bottom cap and the bottom side of separated cell body together define a gas feeding space. The gas feeder is disposed in the gas feeding space, and includes a gas cylinder and a controlling gas valve. The gas cylinder includes a gas cylinder gas outlet, and the gas cylinder is placed in the gas cylinder cell with the gas cylinder gas outlet down. The controlling gas valve is disposed in the gas valve cell, and includes a gas valve inlet and a gas valve outlet. The gas cylinder outlet is connected to the gas valve inlet, while the gas valve outlet is connected to the connecting hole in the bottom of fluid storage space.

In one embodiment, wherein the controlling gas valve includes a control button, which extends from the radial direction of gas valve cell outward to the outside of outer shell.

In one embodiment, wherein the controlling gas valve further includes a valve body, a moving part and at least a gas tight ring. The valve body is disposed in the gas valve cell, and the moving part is disposed in the valve body for translatory shift in radial direction. The gas tight ring is disposed between the moving part and valve body, for gas sealing.

In one embodiment, wherein the controlling gas valve further includes a control button, which extends from the radial direction of gas valve cell downward to the outside of controlling gas valve.

In one embodiment, wherein the controlling gas valve further includes a valve body and a moving part. The valve body is disposed in the gas valve cell, and the moving part is disposed in the valve body for translatory shift in axial direction.

In one embodiment, wherein the controlling gas valve, along with the axial direction from up to down, includes an upper gas tight ring, a gas intake pipe, a moving gas tight ring, a gas outlet pipe and a lower gas tight ring. The upper gas tight ring, the moving gas tight ring and the lower gas tight ring are disposed between the moving part and the valve body, for gas sealing.

In one embodiment, wherein the gas valve cell is adjacently connected to the assembling part of outer shell, and the bottom cap is removably connected to the assembling part of outer shell.

To sum up, a portable bubble water bottle of the present invention can set the gas cylinder into the body of the bubble water bottle to protect the gas cylinder by means of the entirety of the bubble water bottle and avoid the use method of exposed gas cylinder. In this way, it can avoid the danger caused by gas cylinder drop from collision while using.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

DESCRIPTION OF THE PREFERRED EMBODIMENT

In the following description, this invention will be explained with reference to embodiments thereof. However, the description of these embodiments is only for purposes of illustration rather than limitation. It should be appreciated that in the following embodiments and attached drawings, elements unrelated to this invention are omitted from depictions; and dimensional relationships among individual elements in the attached drawings are illustrated only for ease of understanding, but not to limit the actual scale.

Figure 1:
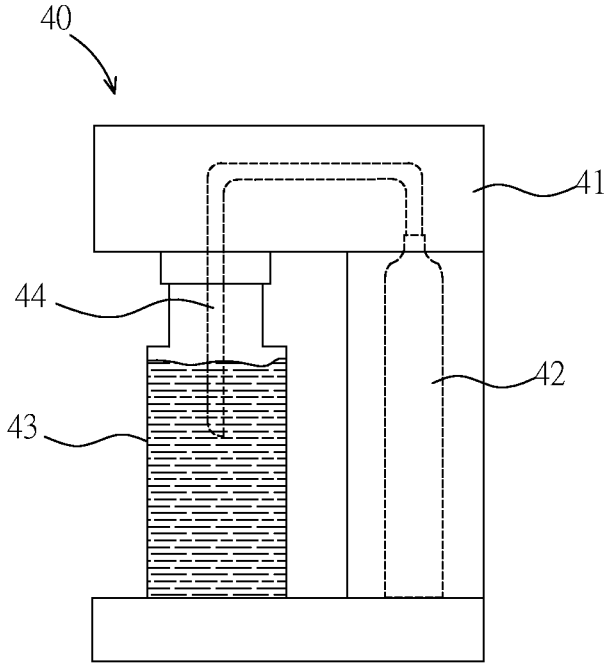
FIG. 1 (PRIOR ART)
FIG. 1 is a schematic diagram showing a prior bubble water machine.
Figure 2:
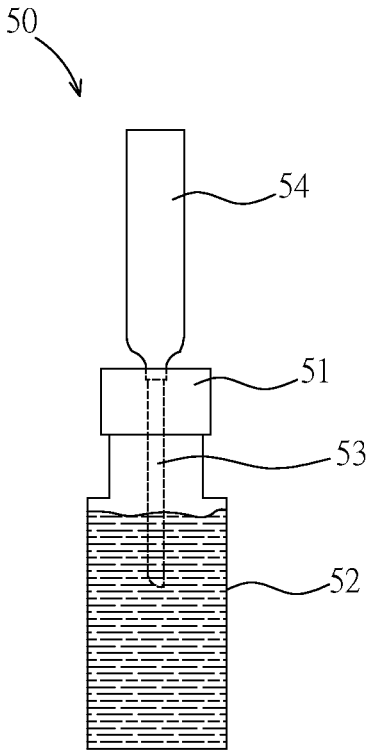
FIG. 2 (PRIOR ART)
FIG. 2 is a schematic diagram showing a prior bubble water bottle.
Figure 3:
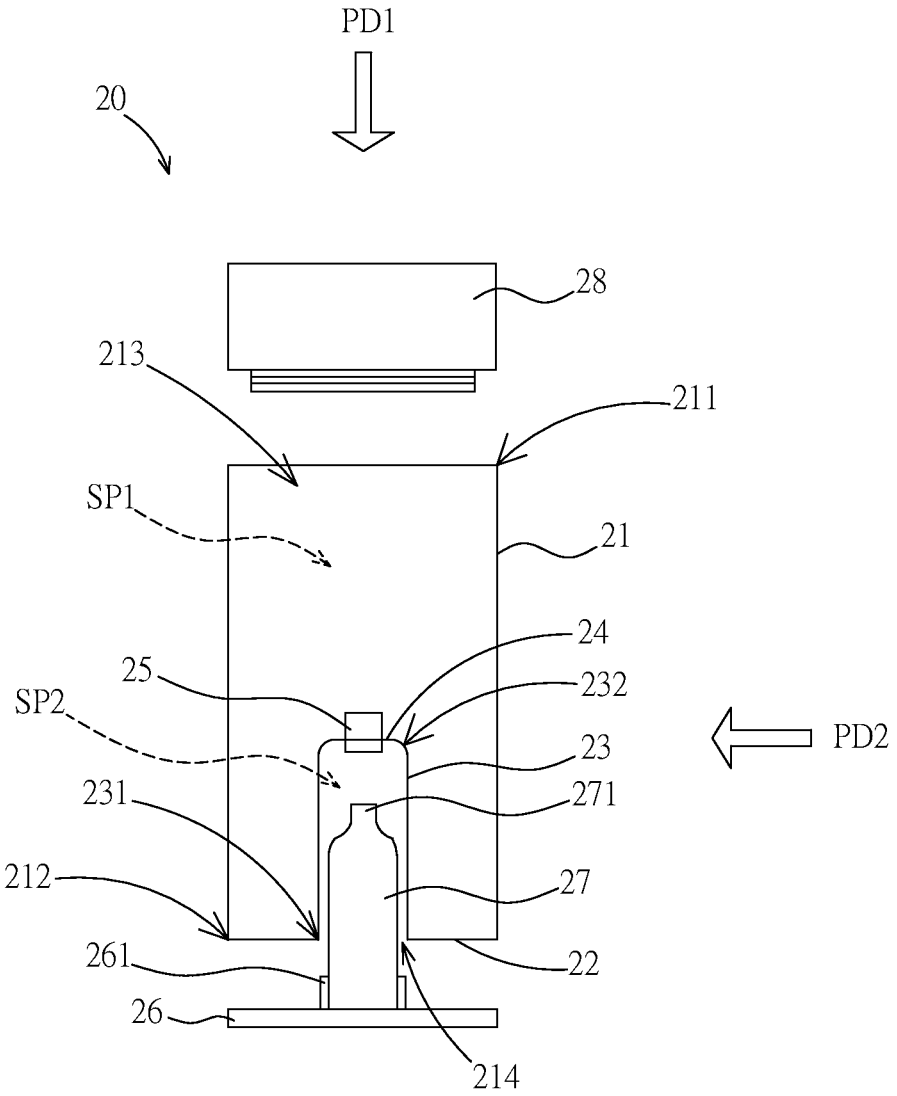
FIG. 3 is a schematic diagram showing a portable bubble water bottle according to a first embodiment of the present invention.

Refer to FIG. 3, a portable bubble water bottle 20 of a first embodiment of the present invention includes a first closed sidewall 21, a first bottom 22, a second closed sidewall 23, a second bottom 24, an one-way gas valve 25, a pedestal 26, a gas cylinder 27 and a cover 28. In the embodiment, the closed sidewall presents a tube-like shape.

The first closed sidewall 21 has a first end 211 and a second end 212, and the first end 211 has a first opening 213, which forms by the closed sidewall 21. The second end 212 is connected to the first bottom 22, which has a second opening 214. In the embodiment, the first bottom 22 is set along the periphery of the second end 212.

The second closed sidewall 23 has a third end 231 and a fourth end 232. The third end 231 is connected to the periphery of the second opening 214 of the first bottom 22, besides, the second closed sidewall 23 is set in an extending way from the second opening 214 towards the first opening 213. The second bottom 24 is connected to the fourth end 232 of the second closed sidewall 23.

In the embodiment, the first closed sidewall 21, the first bottom 22, the second closed sidewall 23 and the second bottom 24 form a first space SP1, while the second closed sidewall 23 and the second bottom 24 form a second space SP2. Besides, in the embodiment, the volume of the second space SP2 is smaller than that of the first space SP1.

Figure 4A:
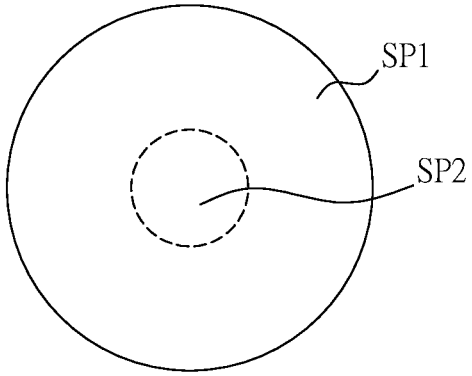
FIG. 4A and FIG. 4B are the projection relationship showing the first space and the second space of portable bubble water bottle of the first embodiment.
Figure 4B:
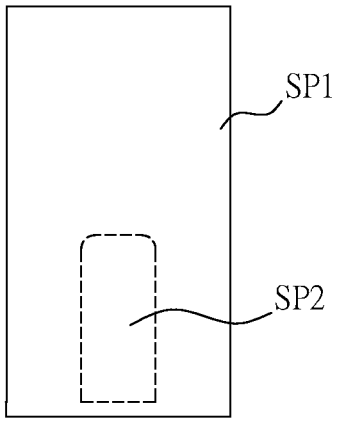

As shown in FIG. 4A, the second space SP2 is located in the first space SP1 along a first projection direction PD1. In the embodiment, the first projection direction PD1 refers to the projection from the first opening 213 towards the second opening 214. As shown in FIG. 4B, the second space SP2 is located in the first space SP1 along a second projection direction PD2. In the embodiment, the second projection direction PD2 has 90 degrees from the first projection direction PD1, and projects towards the second closed sidewall 23 from the first closed sidewall 21.

As shown in FIG. 3, the one-way gas valve 25 is set at the second bottom 24, and connects the first space SP1 with the second space SP2. In the embodiment, the one-way gas valve 25 leads to the first space SP1 from the second space SP2.

The pedestal 26 is connected to the third end 231 of the second closed sidewall 23 to seal the second space SP2. The pedestal 26 has a limited component 261, which is set in an extending way from the pedestal 26 towards the second space SP2 to seal the second space SP2. The limited component 261 is to fix the position of the gas cylinder 27 in the second space SP2, and to avoid displacement of the gas cylinder 27 in the second space SP2 after the pedestal 26 is connected to the third end 231 of the second closed sidewall 23 through clamping, locking or close fit, and the close fit can be done through rubber or other materials with great force of friction.

The one-way gas valve 25 located in the second space SP2 is connected to a gas outlet 271 of gas cylinder 27 to allow the gas in the gas cylinder 27 to flow into the first space SP1. In the embodiment, the gas cylinder 27 may be filled with air or carbon dioxide.

The cover 28 is connected to the first end 211 of the first closed sidewall 21. In the embodiment, the cover 28 is connected to the first closed sidewall 21 in a way of screwing to seal the first space SP1.

In the actual use, the first space SP1 is generally to contain water, juice, tea-based drink, alcoholic beverage and other fluid. After the cover 28 is connected to the first closed sidewall 21 to seal the first space SP1, the bubble beverage is produced when carbon dioxide in gas cylinder 27 enters the first space SP1 via the one-way gas valve 25. The setting of the one-way gas valve 25 may also prevent the fluid in the first space SP1 from flowing into the second space SP2, e.g. install a check valve at the gas outlet of the gas valve to avoid the fluid to flow into the second space SP2.

In the above embodiment, the one-way gas valve 25 is a direct pressure type, while one-way gas valve 25 may also be provided with a gas regulation unit (not shown in the FIG) to release gas in the gas cylinder 27 after pressure reduction, or only to allow to pass gas of certain flow rate by action of the gas regulation unit each time.

Figure 5:
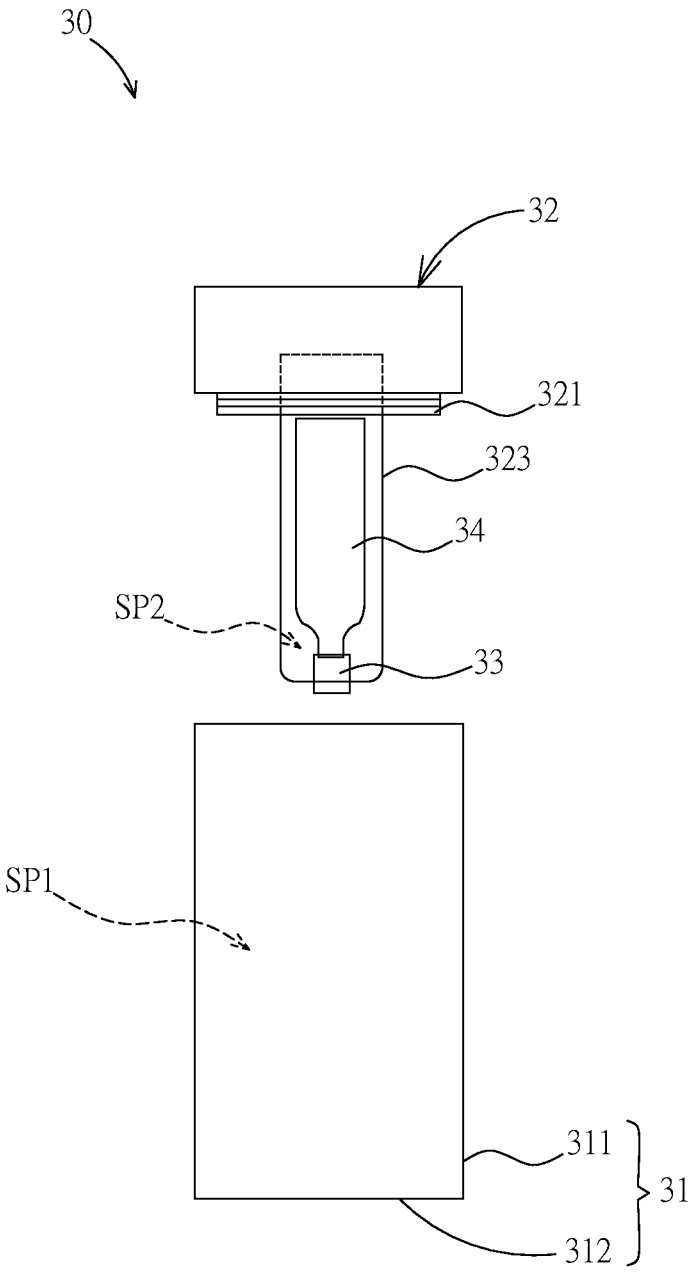
FIG. 5 is a schematic diagram showing a portable bubble water bottle of a second embodiment of the present invention.

Refer to FIG. 5, a portable bubble water bottle 30 of the second embodiment of the present invention includes a bottle 31, a cover 32 and an one-way gas valve 33. In the bottle 31, a closed sidewall 311 and a bottom 312 form the first space SP1. The first space SP1 is to contain water, juice, tea-based drink, alcoholic beverage and other fluid. The cover 32 has a connecting part 321 and the second space SP2. The connecting part 321 is to connect to the bottle 31 and seal the first space SP1. The second space SP2 is set in an extending way from the center of the connecting part 321 of the cover 32 towards the inside of the first space SP1, in other words, the second space SP2 will be included in the first space SP1 of the bottle 31 after the connecting part 321 of the cover 32 is connected to the bottle 31.

The second space SP2 can form by connecting a sub-cover 323 to a bottom surface of the cover 32. After the sub-cover 323 is demounted from the bottom surface, a gas cylinder 34 can be installed in the second space SP2, besides, the gas cylinder 34 is connected to the one-way gas valve 33 set at one end of the sub-cover 323, thus to make the gas in the gas cylinder 34 flow into the first space SP1 via the one-way gas valve 33 and mix the gas with the fluid.

As shown in FIG. 6 to FIG. 10, the portable bubbly water bottle 100 according to the third embodiment includes an outer shell 110, a separated cell body 130, an upper cap 102, a bottom cap 106 and a gas feeder 150.

The outer shell 110 essentially is a cylindrical shell. The outer shell 110 from up to down includes a drinking part 111, a cylinder wall 112 and an assembling part 113. The drinking part 111 of outer shell 110 has a drinking edge 114, which is formed by the edge of the outer shell 110. The cylinder wall 112 of the outer shell 110 is connected with the assembling part 113 and the drinking part 111, and the assembling part 113 has an opening 115. In the embodiment, the assembling part 113 extends along the cylinder wall 112 of the outer shell 110.

The separated cell body 130 is disposed below the outer shell 110. The separated cell body 130 from outside to inside includes a gas valve cell 132 and a gas cylinder cell 134, and the gas valve cell 132 has a connecting hole 132*a*. The gas cylinder cell 134 sinks toward the drinking part 111. The top side of the separated cell body 130 and the inside of the outer shell 110 together define a fluid storage space SP1. The gas valve cell 132 is adjacently connected to the bottom edge of the assembling part 113 of the outer shell 110. It is to be noted that the term "cell" in the present application may be meaning a space or a chamber.

The upper cap 102 connects to the drinking part 111 of the outer shell 110, in the embodiment, the upper cap 102 is assembled by screw assembly, removably connected to the drinking part 111 of the outer shell 110, to seal the fluid storage space SP1.

The bottom cap 106 covers the separated cell body 130 and the assembling part 113 (FIG. 8) of the outer shell 110 from the bottom side, and the top side of the bottom cap 106 and the bottom side of the separated cell body 130 together define a gas feeding space SP2. The bottom cap 106 is removably connected to the assembling part 113 of the outer shell 110. Through the combination of the bottom cap 106 and the outer shell 110, the bottom cap 106 and the separated cell body 130 could seal the gas feeding space SP2. In the embodiment, the volume of the gas feeding space SP2 is smaller than that of fluid storage space SP1. In the embodiment, the bottom cap 106 and the assembling part 113 of the outer shell 110 are realized by screwing manner. In which, the bottom cap 106 and the outer shell 110 could use the rubber or silicone (not indicated in the figure), which has great frictional force, to realize the tight coupling effect.

After connecting the bottom cap 106 and the outer shell 110, the separated cell body 130 is clipped therein, while the separated cell body 130 could fix the gas feeder 150 in the gas feeding space SP2, to avoid the displacement of the gas feeder 150 in the gas feeding space SP2.

The gas feeder 150 is disposed in the gas feeding space SP2, including the gas cylinder 152 and the controlling gas valve 154. The gas cylinder 152 includes the gas cylinder gas outlet 152*b*, and the gas cylinder 152 is placed in the gas cylinder cell 134 with the gas cylinder gas outlet 152*b* adown. In which, the so-called "adown" refers the gas cylinder gas outlet 152*b* keeps away from the drinking part 111 but toward the bottom cap 106. In the embodiment, the gas cylinder 152 is filled with compressed liquid carbon dioxide; whose filling pressure is about 800 p.s.i, while the pressure scope within 100~1000 p.s.i is also commonly used.

After connecting the bottom cap 106 and the outer shell 110, the separated cell body 130 is clipped therein; the gas cylinder cell 134 could fix the gas cylinder 152, while the gas valve cell 132 could fix the controlling gas valve 154, to avoid the misplacement of gas cylinder 152 and controlling gas valve 154 in gas feeding space SP2.

The controlling gas valve 154 is disposed in the gas valve cell 132, to release the gas in the gas cylinder 152, for example, each action only passes through a certain amount of gas.

Figure 6:
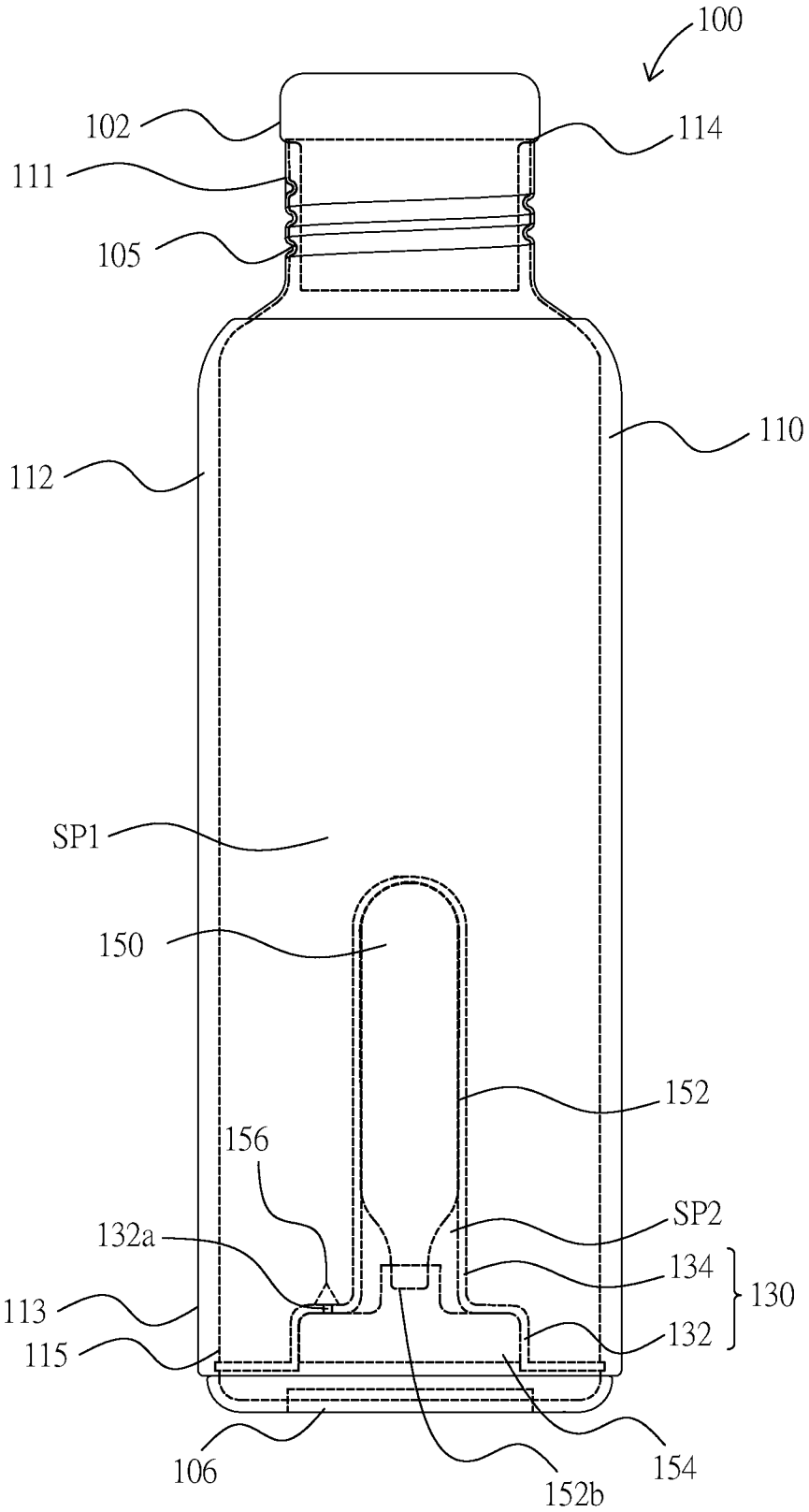
FIG. 6 is a schematic diagram showing a portable bubble water bottle of a third embodiment of the present invention.
Figure 7:
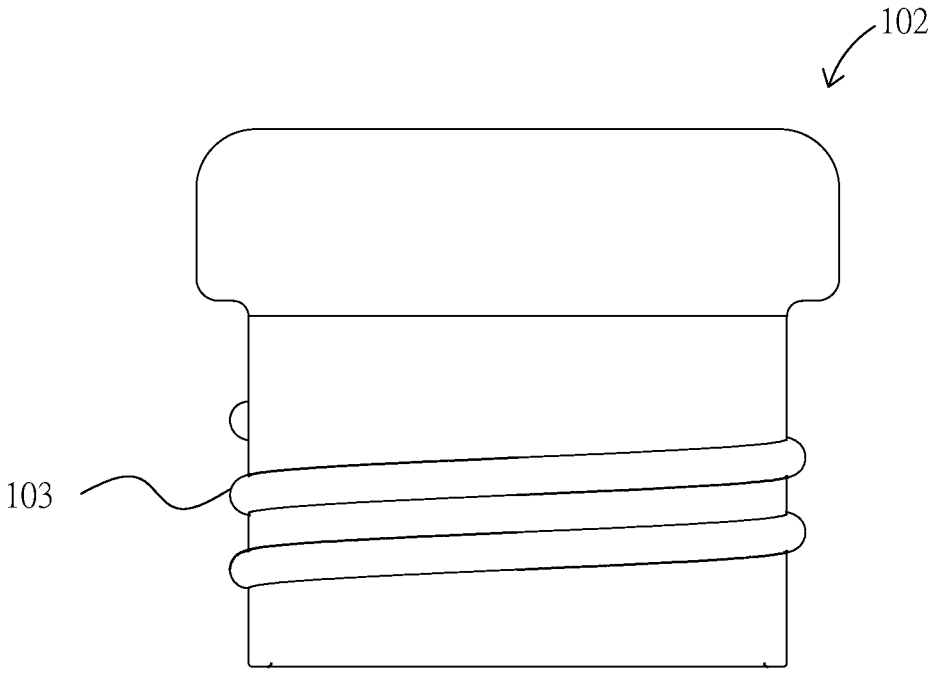
FIG. 7 is a schematic diagram showing the upper cap of the portable bubble water bottle according to the third embodiment of the present invention.
Figure 8:
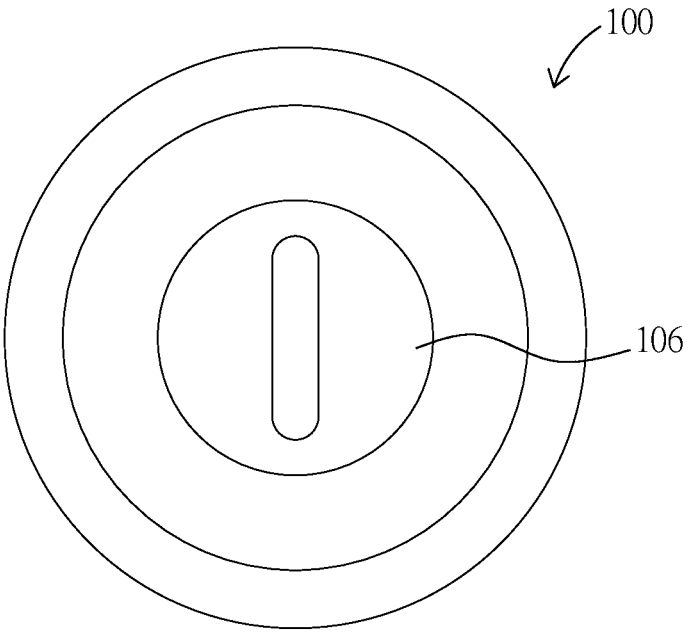
FIG. 8 is a bottom view showing the portable water bottle of the third embodiment of the present invention.
Figure 9:
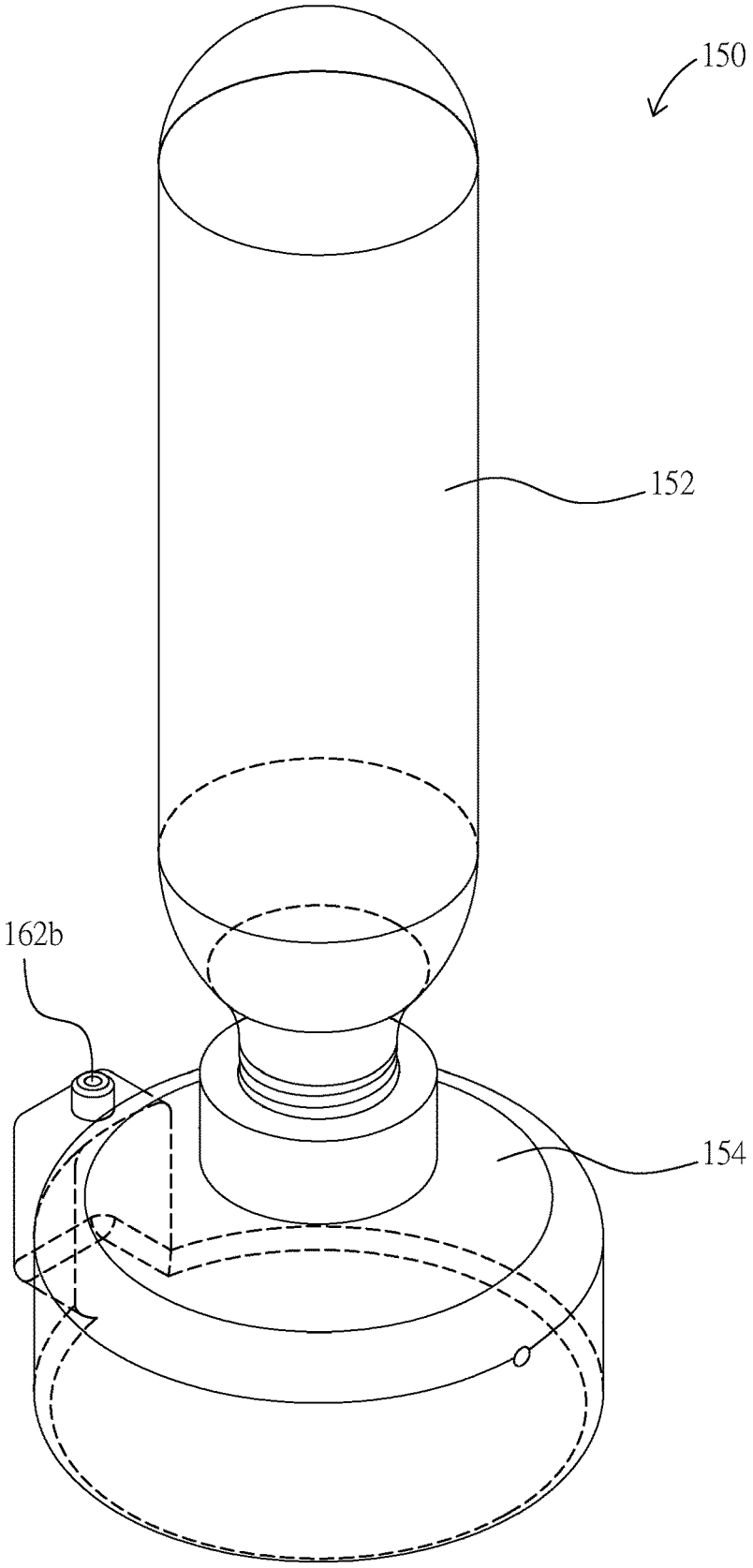
FIG. 9 is a perspective view showing the gas feeder of the portable bubble water bottle according to the third embodiment of the present invention.
Figure 10:
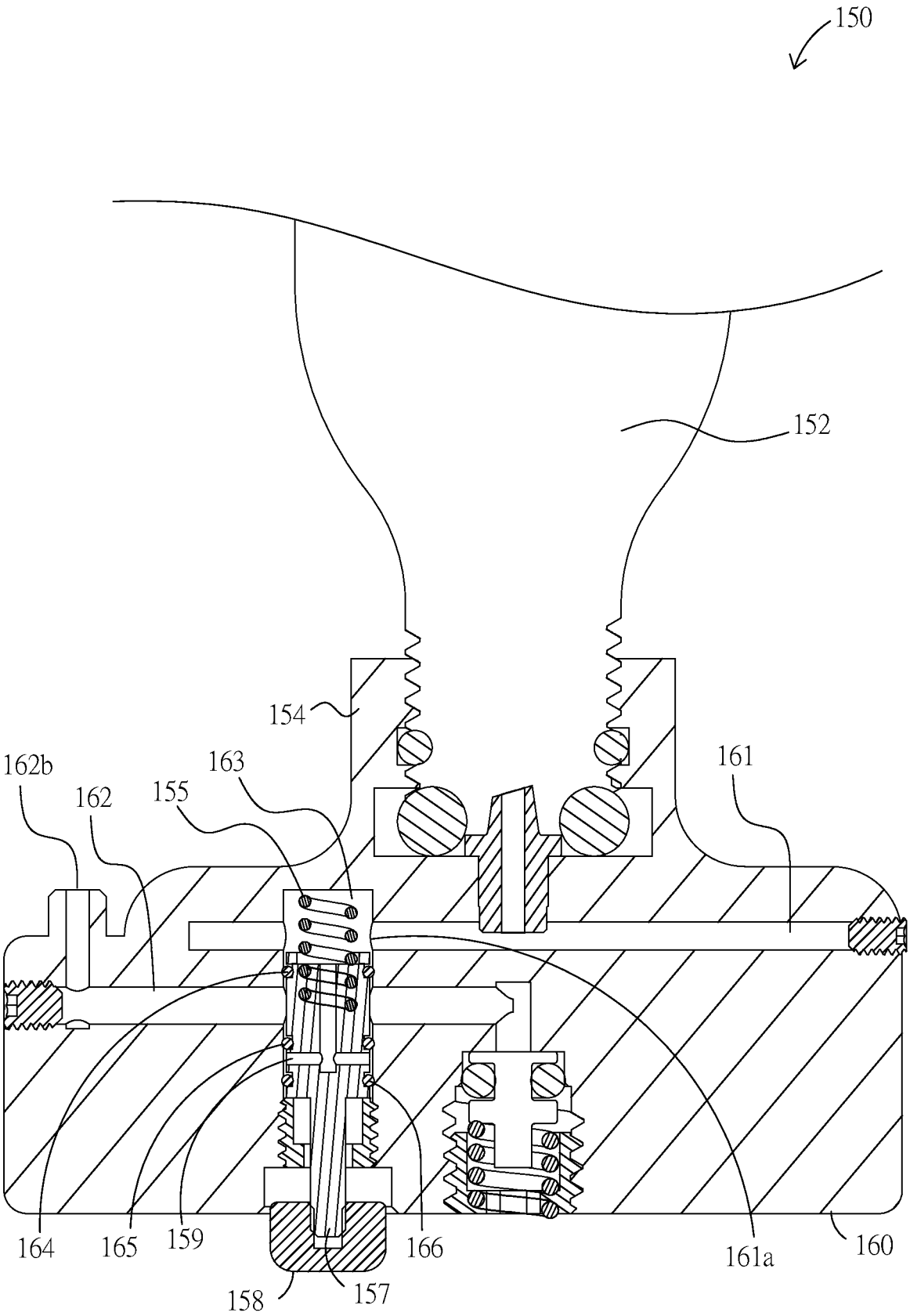
FIG. 10 is a cross-sectional view showing the gas feeder of the portable water bottle according to the third embodiment of the present invention.

As shown in FIG. 6, FIG. 9 and FIG. 10, the controlling gas valve 154 includes a one-way gas valve 156 and a valve body 160. The one-way gas valve 156 is disposed above the connecting hole 132*a* of the gas valve cell 132 (FIG. 6), so that the gas in the gas cylinder 152 flows to the fluid storage space SP1 through controlling the gas valve 154. The one-way gas valve 156 is disposed in the bottom of the fluid storage space SP1, and connects to the fluid storage space SP1 and the gas feeding space SP2 (FIG. 6). If the one-way gas valve 156 is the check valve, it connects to the outlet of the controlling gas valve 154, so that the allowable passing direction is from the gas feeding space SP2 to the fluid storage space SP1, and the liquid in the fluid storage space SP1 could not flow to the gas feeding space SP2.

The valve body 160 is disposed in the gas valve cell 132, through the coordination of shapes of the valve body 160 and the gas valve cell 132, to fix the controlling gas valve 154 in the gas valve cell 132 (FIG. 6 and FIG. 9-10). In the valve body 160, the shape of valve body 160 defines a gas intake pipe 161, a gas outlet pipe 162 and a component room 163 (FIG. 10). The inlet of gas intake pipe 161 is the gas valve inlet 161*a*, connecting to the gas cylinder gas outlet 152*b*. The outlet of gas outlet pipe 162 is the gas valve outlet 162*b*, connecting to the connecting hole 132*a* of the gas valve cell 132 and the one-way gas valve 156, and then further connecting to the fluid storage space SP1 (FIG. 6).

As shown in FIG. 10, in the component room 163, the controlling gas valve 154 from up to down in the axial direction includes a spring 155, a moving part 157 and a control button 158. The control button 158 is the direct pressure type as the example. The control button 158 extends from the gas valve cell 132 downward in the axial direction to the outside of the controlling gas valve 154, while the moving part 157 is disposed in the valve body 160 for translatory shift in the axial direction. The moving part 157 inside has the gas guiding pipe 159, and the gas guiding pipe 159 runs through the moving part 157 in the axial direction, to connect the gas intake pipe 161 and the gas outlet pipe 162 when pressing the control button 158.

In addition, the controlling gas valve 154 includes a upper gas tight ring 164, a moving gas tight ring 165 and a lower gas tight ring 166, which are disposed out of the moving part 157, between the moving part 157 and the valve body 160, for gas sealing, such as to avoid the gas in the gas cylinder 152 leaking from the periphery of control button 158. According to the relative position of each component of the controlling gas valve 154, from up to down in the axial direction, it is the spring 155, the gas intake pipe 161, the upper gas tight ring 164, the gas outlet pipe 162, the moving gas tight ring 165, the gas guiding pipe 159, the lower gas tight ring 166 and the control button 158.

When the control button 158 is not activated, the gas of gas cylinder 152 is connected to the gas valve inlet 161*a* and the gas intake pipe 161 through the gas cylinder gas outlet 152*b*, and the moving part 157 shall seal the gas of the gas cylinder 152 in the gas cylinder 152 and the gas intake pipe 161. When the control button 158 is activated, such as pressing the control button 158, the high pressure gas of the gas cylinder 152 would run from the gas cylinder gas outlet 152*b*, the gas valve inlet 161*a*, the gas intake pipe 161, the gas guiding pipe 159 of the moving part 157, the gas outlet pipe 162, the gas valve outlet 162*b* and the one-way gas valve 156, to the fluid storage space SP1.

When assembling or replacing the gas cylinder 152, the user could firstly take down the bottom cap 106 from the outer shell 110, to get the controlling gas valve 154 and the gas cylinder 152 out of the outer shell 110, and then place the new gas cylinder 152 and the controlling gas valve 154. In which, the outer shell 110, the separated cell body 130, the upper cap 102, the bottom cap 106 and the gas feeder 150 are removable for cleaning or replacement. While in other embodiments, the outer shell 110 and the separated cell body 130 could be fixed with each other.

This invention has the following advantages. Firstly, the gas valve outlet of the portable bubbly water bottle in this invention is connected to the connecting hole at the bottom of the fluid storage space, therefore, the gas would start the gas-liquid mixing from the bottom of the fluid storage space. Through the upward buoyancy force of the bubble, the liquid in the entire fluid storage space could fully contact with the gas, to greatly improve the gas dissolution effect. Secondly, since the gas cylinder gas outlet is placed in the gas cylinder cell adown in this invention, the entire portable bubbly water bottle could be used to strengthen the gas feeding space for enveloping and holding the gas cylinder, and the safety of the bubbly water bottle can be increased.

Moreover, this invention adopts the controlling gas valve design, which could mix the gas and liquid in several times, rather than using up all the gas in the gas cylinder at a time. Therefore, single gas cylinder of this invention could be used for the portable bubbly water bottle for several times. Taking a portable bubbly water bottle with the water capacity of 600 ml as the example, one gas cylinder could be used for 1800 ml liquid for full gas dissolution effect, thus one gas cylinder could be used for the full water mixing for 3 times. In this way, only one portable bubble water bottle can provide an adult's daily intake of water. No need to worry about mixing 1800 ml of bubble water at a time to carry out, which will cause the bubbles in the water to dissipate as the lid opens when drinking, and the problem of excessive load. In addition, as the gas release status can be manually controlled by the user, the user can also adjust the amount of gas-liquid mixture according to their own needs or preferences to achieve the customized effect.

As mentioned above, in the portable bubble water bottle disclosed in the present invention, the second space is included and contained in the first space of the gas cylinder. The first space basically refers to the bottle body composed of the first closed sidewall and the first bottom, therefore, while suing portable bubble water bottle, the gas cylinder is included in the bottle body without being exposed outside, this avoids the danger during using the bubble water bottle. With the entire bottle body for protection, it can increase the safety while using bubble water bottle. In addition, the portable bubble water bottle disclosed in the present invention can greatly improve the gas dissolution effect, increase the safety of bubbly water bottle when it is used, operate easily, dissolve the gas in several times, be easy to carry, reduce the rate of gas escape, and achieve the customized effect.

The above embodiments merely give the detailed technical contents of the present invention and inventive features thereof, and are not to limit the covered range of the present invention. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A portable bubble water bottle, comprising:

an outer shell having a drinking part, a cylinder wall and an assembling part from up to down;

a separated cell body, which is disposed below the outer shell, and has a gas valve cell and a gas cylinder cell from outside to inside, wherein the gas valve cell has a connecting hole, and the gas cylinder cell sinks toward the drinking part, and the top side of the separated cell body and the inside of the outer shell together define a fluid storage space;

a bottom cap, which covers the separated cell body and the assembling part of the outer shell from below, and a top side of the bottom cap and a bottom side of the separated cell body together define a gas feeding space; and a gas feeder, which is disposed in the gas feeding space, and comprising:

a gas cylinder, which includes a gas cylinder gas outlet, and the gas cylinder is placed in the gas cylinder cell with the gas cylinder gas outlet adown; and a controlling gas valve, which is disposed in the gas valve cell, and includes a gas valve inlet, which is connected to the gas cylinder outlet, and a gas valve outlet, which is connected to the connecting hole in the bottom of the fluid storage space.

2. The portable bubble water bottle according to claim 1, further comprises an upper cap, which is removably connected to the drinking part of the outer shell to seal the fluid storage space.

3. The portable bubble water bottle according to claim 2, wherein the upper cap is assembled with the drinking part of the outer shell by screwing manner, clipping manner or clamping manner.

4. The portable bubble water bottle according to claim 1, wherein the controlling gas valve further comprises a control button, which extends from the radial direction of gas valve cell outward to the outside of outer shell.

5. The portable bubble water bottle according to claim 4, wherein the controlling gas valve further comprising:

a valve body, which is disposed in the gas valve cell;

a moving part, which is disposed in the valve body for translatory shift in radial direction; and at least a gas tight ring, which is disposed between the moving part and valve body for gas sealing.

6. The portable bubble water bottle according to claim 1, wherein the controlling gas valve further comprises a control button, which extends from the radial direction of the gas valve cell downward to the outside of the controlling gas valve.

7. The portable bubble water bottle according to claim 6, wherein the controlling gas valve further comprising:

a valve body, which is disposed in the gas valve cell; and a moving part, which is disposed in the valve body for translatory shift in axial direction.

8. The portable bubble water bottle according to claim 7, wherein the controlling gas valve comprises an upper gas tight ring, a gas intake pipe, a moving gas tight ring, a gas outlet pipe and a lower gas tight ring along with the axial direction from up to down, and the upper gas tight ring, the moving gas tight ring and the lower gas tight ring are disposed between the moving part and the valve body for gas sealing.

9. The portable bubble water bottle according to claim 1, wherein the gas valve cell is adjacently connected to the assembling part of the outer shell, and the bottom cap is removably connected to the assembling part of outer shell.

10. A portable bubble water bottle, comprising:

a first space for containing fluid;

a second space being independent to the first space;

a gas feeder, which is disposed in the second space, and comprising:

a gas cylinder, which includes a gas cylinder gas outlet, and the gas cylinder is placed in the second space with the gas cylinder gas outlet adown; and a one-way gas valve, which is placed between the first space and the second space and connected to the gas cylinder gas outlet;

a controlling gas valve, which includes a gas valve inlet, which is connected to the gas cylinder outlet, and a gas valve outlet, which is connected to the first space;

wherein a projection of the first space and a projection of the second space are overlapping in a first direction; and wherein the projection of the first space and the projection of the second space are overlapping in a second direction, and the first direction is 90 degrees from the second direction.

11. The portable bubble water bottle according to claim 10, wherein a projection of the gas cylinder and the projection of the first space are overlapping in the first direction.

12. The portable bubble water bottle according to claim 10, wherein a projection of the gas cylinder and the projection of the first space are overlapping in the second direction.

* * * * *